US007963130B2

(12) United States Patent
Kim

(10) Patent No.: US 7,963,130 B2
(45) Date of Patent: Jun. 21, 2011

(54) HEATER-COMBINING STRUCTURE OF WASHING MACHINE

(75) Inventor: Byung Chan Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 630 days.

(21) Appl. No.: 11/628,973

(22) PCT Filed: Jun. 7, 2005

(86) PCT No.: PCT/KR2005/001691

§ 371 (c)(1),
(2), (4) Date: Dec. 8, 2006

(87) PCT Pub. No.: WO2005/124007

PCT Pub. Date: Dec. 29, 2005

(65) Prior Publication Data

US 2008/0011023 A1 Jan. 17, 2008

(30) Foreign Application Priority Data

Jun. 21, 2004 (KR) ..... 10 2004-0046010
Jun. 21, 2004 (KR) ..... 10-2004-0046011
Jun. 21, 2004 (KR) ..... 10-2004-0046012

(51) Int. Cl.
*D06F 39/04* (2006.01)

(52) U.S. Cl. ..... 68/15; 68/3 R; 68/12.15

(58) Field of Classification Search ..... 68/12.15, 68/15, 3 R
See application file for complete search history.

(56) References Cited

U.S. PATENT DOCUMENTS

| | | | | |
|---|---|---|---|---|
| 5,347,610 | A | 9/1994 | Lee et al. | |
| 5,388,178 | A * | 2/1995 | Moon | 392/444 |
| 6,789,404 | B2 * | 9/2004 | Kim et al. | 68/15 |
| 2004/0083770 | A1 | 5/2004 | Lyu | |

FOREIGN PATENT DOCUMENTS

| | | | |
|---|---|---|---|
| CN | 1046327 | A | 11/1999 |
| JP | 50-157764 | | 12/1975 |
| JP | 2-138687 | U | 11/1990 |
| JP | 4-112392 | U | 9/1992 |
| JP | 2001-149685 | A | 6/2001 |
| KR | 1999-33913 | A | 5/1999 |
| KR | 2003-55973 | A | 7/2003 |
| WO | WO 03/056093 | A1 | 7/2003 |

* cited by examiner

*Primary Examiner* — Joseph L Perrin
*Assistant Examiner* — Benjamin Osterhout
(74) *Attorney, Agent, or Firm* — Birch, Stewart, Kolasch & Birch, LLP

(57) ABSTRACT

A washing machine includes a water-storing tub for storing washing water, a heater having a heat-generating unit disposed in the water-storing tub and a terminal unit formed on first and second ends of the heat-generating unit, a heater cover covering the heater, a clamp fastening the heat-generating unit, a thermostat associated with the clamp to detect a temperature of the heater, and a water infiltration protecting cover for protecting the terminal unit.

14 Claims, 4 Drawing Sheets

[Fig. 1]
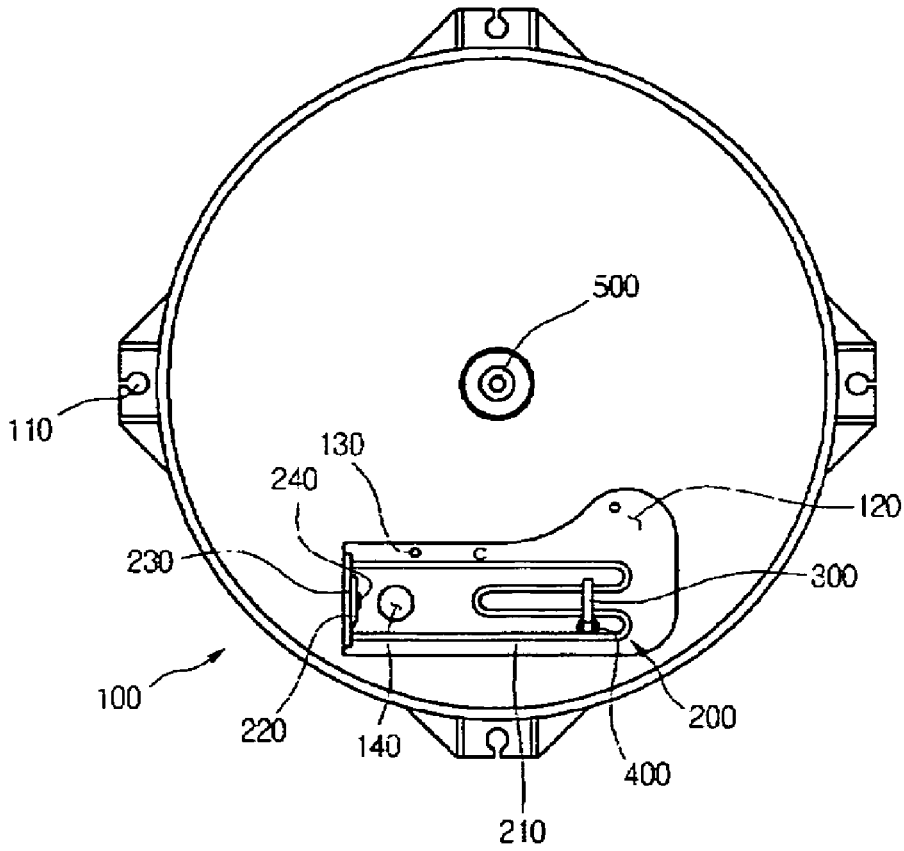
[Fig. 2]
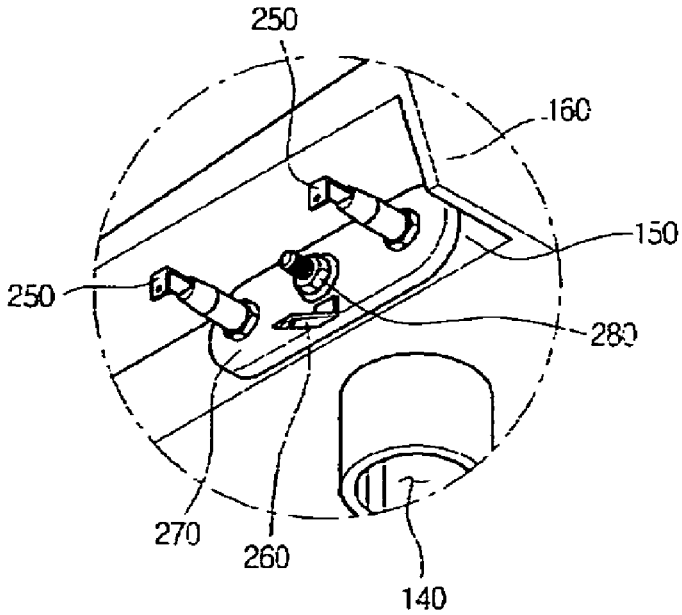

[Fig. 3]
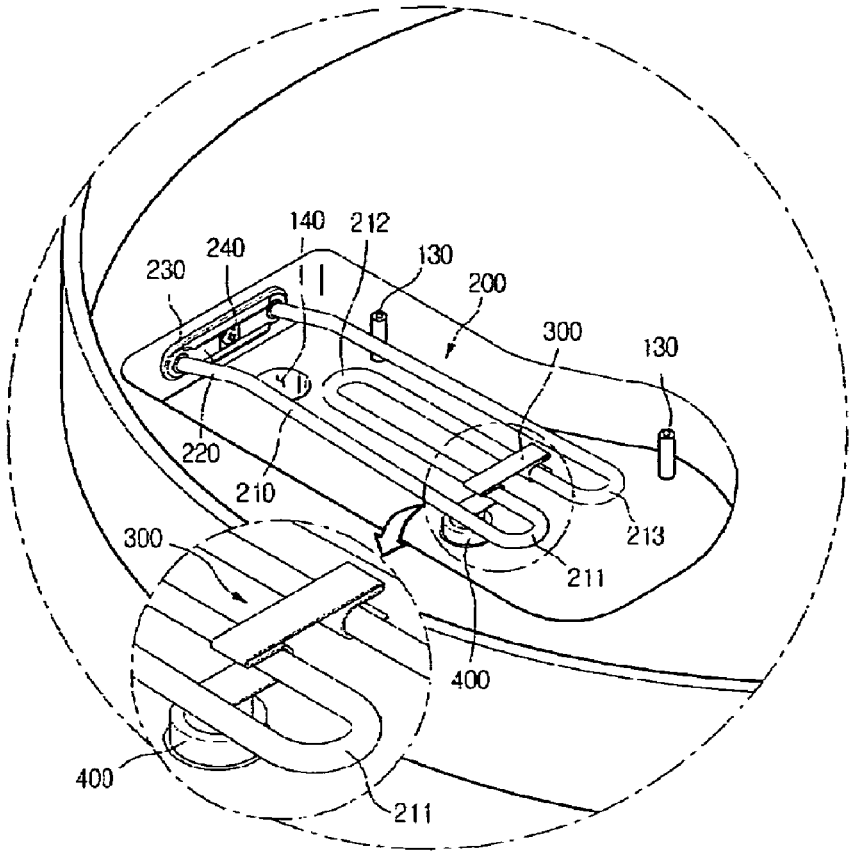
[Fig. 4]
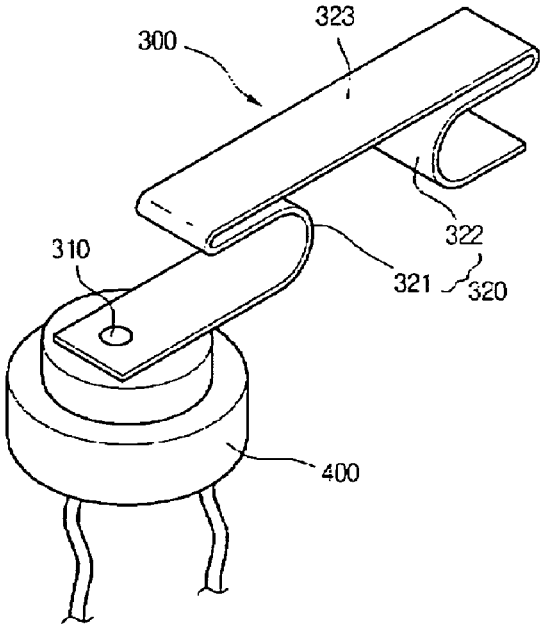

[Fig. 5]
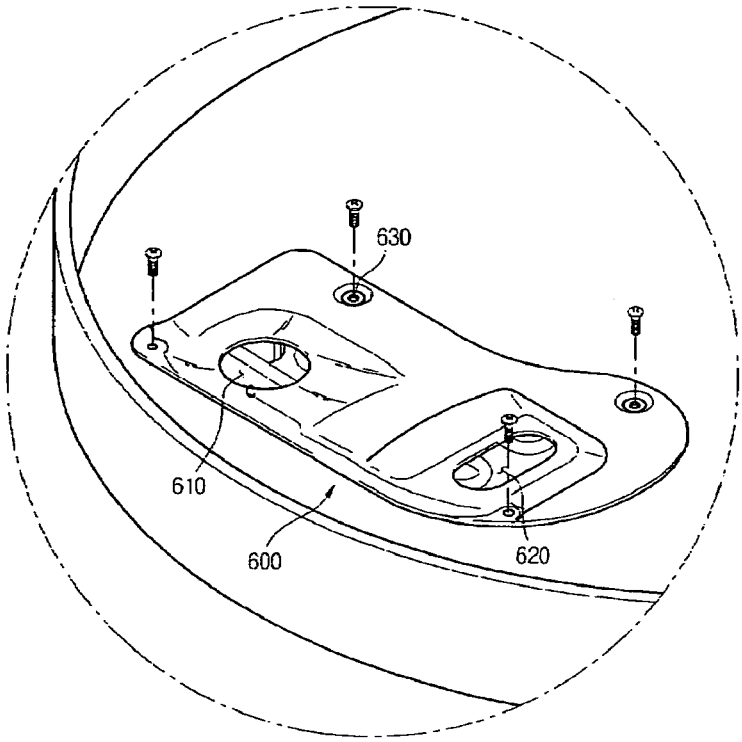
[Fig. 6]
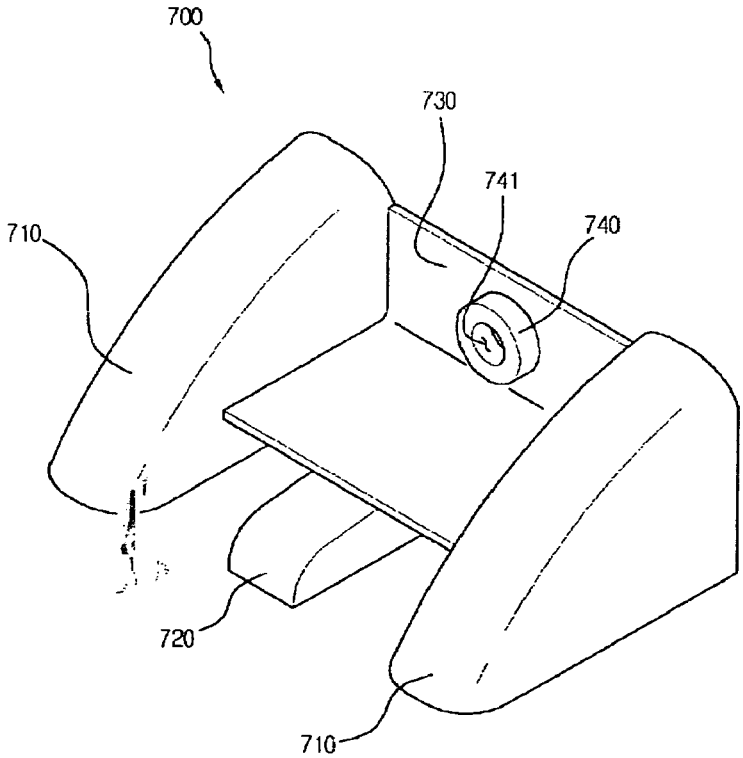

[Fig. 7]
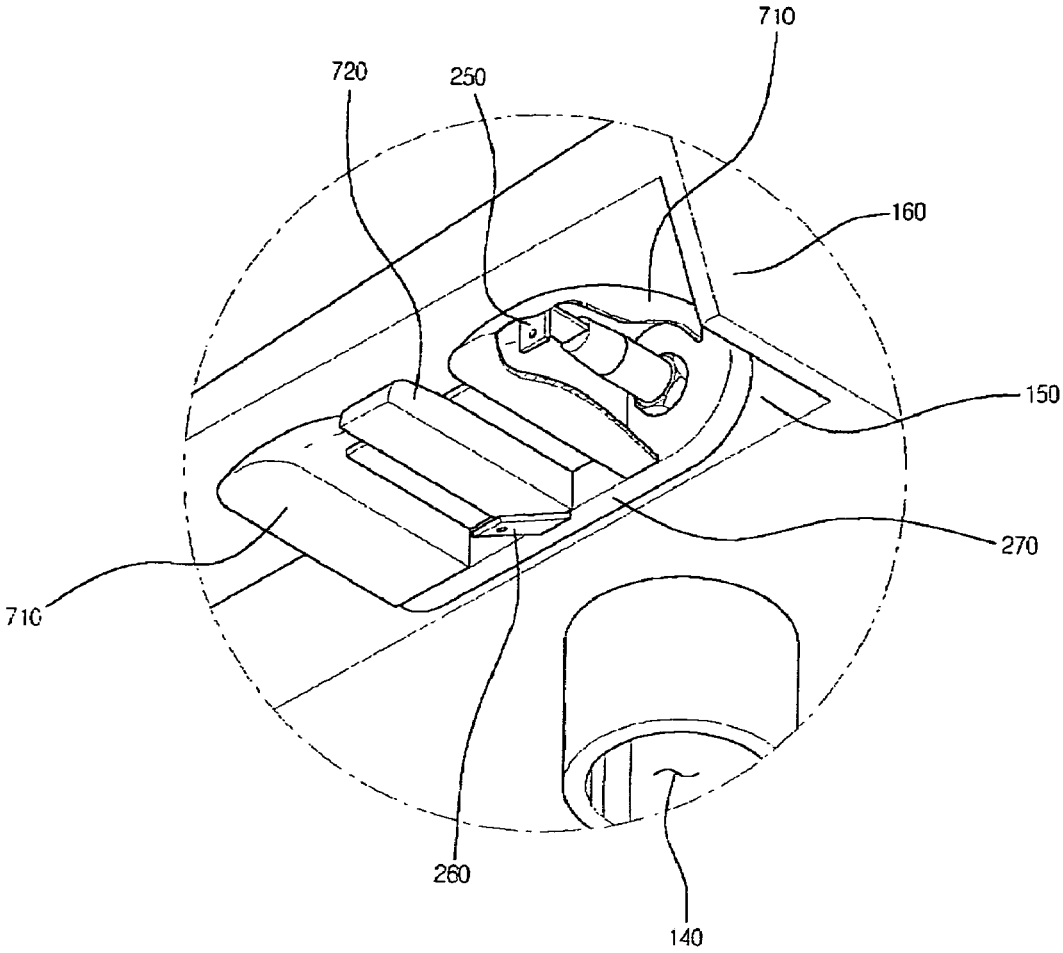

HEATER-COMBINING STRUCTURE OF WASHING MACHINE

TECHNICAL FIELD

The present invention relates to a washing machine, and more particularly, to a washing machine with an improved heater-combining structure that is mounted on a bottom surface of a water-storing tub to heat washing water.

BACKGROUND ART

Generally, a washing machine includes a cabinet defining an outer appearance of the washing machine and a water-storing tub installed in the cabinet. The water-storing tub is supported by a damper connected to an upper portion of the cabinet. A washing tub is rotatably installed in the water-storing tub. The washing tub is provided at a bottom and a side wall with a plurality of through holes so that washing water can flow between the washing tub and the water-storing tub to remove the dirt from the laundry.

Meanwhile, a heater is installed on a bottom surface of the water-storing tub. Thus, even when cold water is supplied into the water-storing tube, the cold water can be heated to a proper temperature by the operation of the heater. As a result, there is no need to connect the washing machine to a warm water tap.

Korean patent publication No. 10-2003-0055973 to the applicant of the present invention discloses such a washing machine with the heater.

In the washing machine disclosed in the patent, the heater is installed in a concave depressed on the bottom surface of the water-storing tube by a predetermined depth. Therefore, a pressure different may be incurred between the bottom surface of the water-storing tub and the concave.

In addition, when the heater is over-heated, there may be a fire since there is no means for letting a user know the overheat of the heater.

Furthermore, in order to change fittings such as a clamp fixing the heater, all of parts such as a top cover, a washing tube and the like that constitute the washing machine must be disassembled, thereby deteriorating the service efficiency.

In addition, a heat generating part of the heater is installed inside the water-storing tube while a terminal part of the heater is projected out of the bottom surface of the water-storing tub, the washing water flowing along an outer circumference of the water-storing tub may soaks through the terminal part, causing the short circuit.

DISCLOSURE OF INVENTION

Technical Problem

Accordingly, the present invention is directed to a washing machine with an improved heater-mounting structure that substantially obviates one or more problems due to limitations and disadvantages of the related art.

An object of the present invention is to provide a washing machine that can uniformly maintain water pressure in a water-storing tub by improving a heater-mounting structure.

Another object of the present invention is to provide a washing machine that can prevent a fire by improving a heater-mounting structure.

A still another object of the present invention is to provide a washing machine that is designed to change or fix parts relating to a heater without disassembling parts such as a top cover and a washing tub, thereby improving the service efficiency.

A still yet another object of the present invention to provide a washing machine that is designed to prevent a short circuit by protecting a heater terminal part projected out of a water-storing tub from moisture.

Technical Solution

To achieve these objects and other advantages and in accordance with the purpose of the invention, as embodied and broadly described herein, there is provided a washing machine including: a water-storing tub for storing washing water; a heater comprising a heat-generating unit disposed in the water-storing tub and a terminal unit formed on first and second ends of the heat-generating unit; a heater cover covering the heater; a clamp fastening the heat-generating unit; a thermostat associated with the clamp to detect a temperature of the heater; and a water infiltration protecting cover for protecting the terminal unit.

ADVANTAGEOUS EFFECTS

According to the present invention, since a height difference between a bottom surface of a water-storing tub and a heat-receiving portion is eliminated, the water pressure can be uniformly maintained.

BRIEF DESCRIPTION OF THE DRAWINGS

FIG. 1 is a plane view of a bottom surface of a water-storing tub, on which a heater is mounted, of a washing machine according to an embodiment of the present invention;

FIG. 2 is a rear perspective view of a water-storing tub on which a heater depicted in FIG. 1 is mounted;

FIG. 3 is an enlarged view of a heater mounted on a clamp according to the present invention;

FIG. 4 is an enlarged view of a claim depicted in FIG. 3;

FIG. 5 is a perspective view of a heater cover mounted on a heater receiving cavity according to the present invention;

FIG. 6 is a perspective view of a water infiltration preventing cover according to an embodiment of the present invention; and FIG. 7 is an enlarged view of a water-storing tub on which a water infiltration preventing cover depicted in FIG. 6 is mounted.

BEST MODE FOR CARRYING OUT THE INVENTION

Hereinafter, preferred embodiments of a leakage preventing structure of a dishwasher according to the present invention will be described in detail with reference to the accompanying drawings. While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

FIG. 1 is a plane view of a bottom surface of a water-storing tub, on which a heater is mounted, of a washing machine according to an embodiment of the present invention and FIG.

2 is a rear perspective view of a water-storing tub on which a heater depicted in FIG. 1 is mounted.

Referring to FIGS. 1 and 2, a water-storing tub 100 of a washing machine according to the present invention is formed in a cylindrical shape having a predetermined diameter and a height.

The water-storing tub 100 is provided at a sidewall with a damper insertion groove 110 to which a first end of a damper is coupled and at a center portion with a hole through which a washing shaft 500 penetrates. A heater-receiving cavity 120 is depressed on a bottom surface of the water-storing tub 100 by a predetermined depth to receive a heater 200.

The heater-receiving cavity 120 is provided at a bottom surface with a drain hole 140 through which washing water is drained and at an edge of the bottom surface with at least one heater cover coupling boss 130.

A thermostat 400 for detecting if the heater 200 is overheated is mounted on a portion of the heater-receiving cavity 120. A clamp 300 fixing the heater 200 is mounted on the thermostat 400.

The water-storing tub 100 is further provided at the bottom surface with a heater insertion slot 150 in which the heater 200 is inserted and a water infiltration preventing rib 160 preventing washing water from infiltrating into a terminal part of the heater 200. That is, the heater insertion slot 150 is depressed on the bottom surface of the water-storing tub 100 to prevent moisture or washing water from infiltrating into the terminal part of the heater 200.

The heater 200 received in the heater receiving groove 120 has a predetermined diameter and a predetermined length, including a heat-generating unit 210 bent at a plurality of locations and power terminals 250 electrically coupled to respective opposite ends of the heat-generating unit 210 to apply power to the heat-generating unit 210.

A sealing member 230 is inserted through the power terminals 250. Before the sealing member 230 is inserted, a pressing plate 220 for pressing the sealing member 230 is inserted. A sealing case 270 for preventing the washing water from leaking through the heater insertion slot 150 is inserted in rear of the seal member 230. The sealing case 270 is depressed by a predetermined depth to receive the sealing member 230. The sealing case 270 includes a ground terminal 260 formed between the power terminals 250. The sealing case 270 tightly contacts an outer wall of the water-storing tub 100 by a fastening member that will be described later.

The pressing plate 220 and the sealing case 270 are tightly combined with each other by a fastening bolt 240 and a fastening nut 280 that penetrate a center portion of the pressing plate 220. As the fastening nut 280 is screwed on the fastening bolt 240 in a fastening direction, the sealing member 230 receives high compressing force between the pressing plate 220 and the sealing case 270. The sealing member 230 may be formed of material such as rubber having predetermined elastic force and flexibility.

Describing in more detail, the sealing member 230 is formed having a size identical to or slightly greater than the heater insertion slot 150 so that it can be easily inserted into the heater insertion slot 150. However, a thickness of the sealing member 230 is formed to be greater than that of the water-storing tub 100.

When the sealing member 230 receives the compressing force by the fastening bolt 240 and the fastening nut 280, an upper portion of the sealing member 230 is spread on an inner circumference of the water-storing tub 100 as shown in the drawing. The spreading area of the sealing member 230 is greater than an area of the heater insertion slot 150. Therefore, when the sealing member 230 is spread by the compressing force, the heater insertion slot 150 is completely sealed, thereby preventing the washing water from leaking through the heater insertion slot 150.

FIG. 3 is an enlarged view of a heater mounted on a clamp according to the present invention and FIG. 4 is an enlarged view of a claim depicted in FIG. 3.

Referring to FIGS. 3 and 4, the heat-generating unit 210 of the heater 200 is securely fixed by the clamp 300 so as not to shake by the flow of the washing water in the water-storing tub 100.

The heat-generating unit 210 is a conductive member having a predetermined diameter and a length and is bent at a plurality of locations. That is, the heat-generating unit 210 includes a first bent portion 211 distant from a first end of the heat-generating unit 210 at a predetermined length, a second bent portion 212 distant from the first bent portion 211 at a predetermined length, and a third bent portion 213 distant from the second bent portion 212 at a predetermined length. A length from the third bent portion 213 to a second end of the heat-generating unit 210 is identical to that from the first bent portion 211 to the first end of the heater-generating unit 210.

Here, the length and the number of bent portions of the heat-generating unit 210 are not limited to the embodiment. They can be appropriately varied according to a designed length of the heat-generating unit 210.

A first end of the clamp 300 is mounted on the thermostat 400 detecting if the over-heat of the heater so as to function to transmit a current state of the heat-generating unit 210 to the thermostat 400.

Meanwhile, the clamp 300 is formed of metal having predetermined strength. The clamp 300 is provided at the first end with a coupling point 310 bonded on the thermostat 400. The clamp 300 is provided with at least one curved portion 320 in which the heat-generating unit 210 of the heater 200 is inserted.

Describing in more detail, the clamp 300 is formed horizontally extending from the coupling point 310 by a predetermined length. The clamp 300 is provided at a portion distant from the coupling point 310 at a predetermined interval with a first curved portion 321 bent at a predetermined curvature. The clamp 300 is further bent at a point distant from the first curved portion 321 in an opposite direction to that of the first curved portion 321. A horizontal section 323 is formed extending from the bent point by a predetermined length.

Meanwhile, the clamp 300 is bent with reference to a vertical line passing through a central point. Therefore, a second curved portion 322 is symmetrically formed with respect to the first curved portion 321. The heat-generating unit 210 is fixedly inserted in the first and second curved portions 321 and 322.

Heat generated by the heat-generating unit 210 is transmitted to the first and second curved portions 321 and 322 and is then to the coupling point 310. The heat transmitted to the coupling point 310 is transmitted to the thermostat 400. Thus, the thermostat 400 can detect the temperature of the heat-generating unit 210. A detected signal is transmitted to a control unit of the washing machine.

An inserting operation of the heat-generating unit 210 of the heater 200 into the clamp 300 will be described hereinafter with reference to FIGS. 1 through 4.

First, the heater 200 is inserted into the water-storing tub 100 through the heater insertion slot 150. That is, the first and third bent portions 211 and 213 defining a front portion of the heat-generating unit 210 are inserted through the heater insertion slot 150. Then, an inner curvature surface of the first bent portion 211 and an inner curvature surface of the third bent portion 213 contact the curved portion 320 of the clamp 300.

Describing in more detail, the inner curvature surface of the first bent portion 211 contacts the first curved portion 321 while the inner curvature surface of the second bent portion 212 contacts the second curved portion 322. When the heater 200 is further pushed in an insertion direction, a straight section of the heat-generating unit, which extends from the first bent portion 211, is to be inserted into the first curved portion 321 while a straight section of the heat-generating unit 210, which extends from the second bent portion 212, is to be inserted into the second curved portion 322.

Meanwhile, when it is intended to change the clamp 300 or the thermostat 400 due to the aging or other problems, the heater 200 is first pulled to be removed from the curved portion 320 of the clamp 300. Then, the thermostat 400 is pulled downward from the water-storing tub 100 to be removed from the bottom surface of the water-storing tub 100. Here, since the clamp 300 and the thermostat 400 is arranged in a □-shape, the thermostat 400 removed from the water-storing tub 100 rotates by an angle of 90. In addition, the clamp 300 is withdrawn at an angle where the horizontal section 323 is in a vertical state.

In a prior heater-mounting structure defining, for example, a T-shape where a thermostat 400 is mounted on a center of a clamp 300, the washing tub must be disassembled to change or remove the clamp 300. However, in the present invention, by mounting the thermostat 400 on a first end of the clamp 300, the clamp 300 can be easily removed from the water-storing tub 100.

FIG. 5 is a perspective view of a heater cover mounted on a heater-receiving cavity according to the present invention.

Referring to FIG. 5, in order to reduce the pressure variation caused by a height difference between the bottom surface of the water-storing tub 100 and the bottom surface of the heater-receiving cavity 120, there is provided a heater cover 600 covering the heater-receiving cavity 120.

That is, the heater cover 600 functions to evenly level the heights of the water-storing tub 100 and the heater receiving cavity 120 and to prevent the laundry from directly contacting the heater 200, thereby preventing the fire and the damage of the laundry.

Describing in more detail, the heater cover 600 is formed of fireproof material such as stainless steel that is lightweight.

In addition, the heater cover 600 is provided with a penetration groove 630 corresponding the heater cover coupling boss 130 formed on the edge of the heater receiving cavity 120. The heater cover 600 is further provided with a washing water introduction slot 610 directing the washing water stored in the water-storing tub 100 to the heater-receiving cavity 120. The heater cover 600 is further provided with a washing water discharge slot 620 that is distant from the washing water introduction groove 610 by a predetermined interval.

Here, since a peripheral portion defining the washing water introduction slot 610 is depressed downward from a surface of the heater cover 600 by a predetermined depth, the washing water can be effectively directed to the heater-receiving cavity 120. On the contrary, a peripheral portion defining the washing water discharge slot 620 is depressed upward from the surface of the heater cover 600 so that the washing water stored in the heater-receiving cavity 120 can be effectively discharged to the water-storing tub 100.

FIG. 6 is a perspective view of a water infiltration preventing cover according to an embodiment of the present invention and FIG. 7 is an enlarged view of a water-storing tub on which a water infiltration preventing cover depicted in FIG. 6 is mounted.

Referring to FIGS. 6 and 7, the heat-generating unit 210 is inserted inside the water-storing tub 100. However, the power terminals 250 connected to the opposite ends of the heat-generating unit 210 are projected out of the water-storing tub 100. Thus, there is a possibility of the infiltration of the washing water flowing along an outer wall of the washing tub 100 into the power terminals 250 and the ground terminal 260, thereby causing the short circuit.

Therefore, in the present invention, there is provided a water infiltration preventing cover 700 preventing the washing water from being infiltrated into the power terminals.

Describing in more detail, the water infiltration preventing cover 700 includes a sealing case receiving member 730, power terminal protecting covers 710 formed on both sides of the sealing case receiving member 730, and a ground terminal protecting cover 720 formed between the power terminal protecting covers 710.

The sealing case receiving member 730 includes a fastening nut receiving cover 740 that is projected at a center of the sealing case receiving member 730 at a predetermined diameter and a height. The fastening nut receiving cover 740 is provided at a center with a fastening bolt penetration hole 741.

In addition, the power terminal protecting cover 710 is curved downward to prevent the washing water flowing along the outer wall of the water-storing tub 100 from being infiltrated into the power terminals 250. The ground terminal protecting cover 720 is formed between the power terminals 250. The ground terminal protecting cover 720 is designed to cover the ground terminal 260 to protect the ground terminal 270 projected downward from the fastening nut receiving cover 740.

In addition, since the water infiltration preventing cover 700 functions to protect the power and ground terminals 250 and 260 by covering the same, it may contact the terminals 250 and 260. Thus, it is preferable that the water infiltration preventing cover 700 is formed of non-conductive material such as plastic.

Meanwhile, in order to mount the water infiltration preventing cover 700 on an outer circumference of the water-storing tub 100, an end of the fastening bolt 240 is first inserted through the fastening bolt penetration hole 741. Then, an additional nut is inserted around the end of the fastening bolt 240 and tightly fastened on the bolt 240 by being rotated.

Here, the shape and size of the protecting covers 710 and 720 are not limited to the above case. All of the protecting covers mounted to protect the terminals 250 and 260 may come within the scope of the present invention.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the present invention, since a height difference between a bottom surface of a water-storing tub and a heat-receiving portion is eliminated, the water pressure can be uniformly maintained. Therefore, the present invention has a high industrial applicability.

The invention claimed is:

1. A washing machine comprising:

a water-storing tub for storing washing water, the water-storing tub having a heater insertion slot;

a heater comprising a heat-generating unit disposed in the water-storing tub, a terminal unit formed on first and second ends of the heat generating unit, and a sealing case that covers the heater insertion slot to prevent the washing water from leaking through the heater insertion slot;

a heater cover covering the heater;

a clamp fastening the heat-generating unit;

a thermostat associated with the clamp to detect a temperature of the heater; and a water infiltration protecting cover coupled to an outside of the water-storing tub to prevent the washing water from being infiltrated into the terminal unit, wherein the water infiltration protecting cover entirely covers and protects the terminal unit, the water infiltration protecting cover including a sealing case contacting member in contact with the sealing case and at least one terminal protecting cover formed on the sealing case contacting member to enclose the terminal unit.

2. The washing machine according to claim 1, wherein the heater is disposed above an inner bottom surface of the water-storing tub while the heater cover covers an upper portion of the heater.

3. The washing machine according to claim 1, wherein the thermostat is directly coupled to the bottom surface of the water-storing tub and a first end of the clamp is bonded on the thermostat.

4. A washing machine comprising:

a water-storing tub for storing washing water;

a washing tub rotatably located in the water-storing tub to accommodate laundry;

a heater-receiving cavity depressed on a bottom surface of the water-storing tub;

a heater mounted on the heater-receiving cavity to heat the washing water; and a heater cover disposed within the water storing tub and configured to cover the heater and the heater receiving cavity, the heater cover including:

a washing water introduction slot through which the washing water is introduced into the heater-receiving cavity; and a washing water discharge slot through which the washing water is discharged out of the heater-receiving cavity, wherein the heater-receiving cavity is provided at a bottom surface with at least one heater cover coupling boss, the heater cover is provided with at least one coupling hole through which a coupling member penetrates, the heater cover covers the heater in a state where the heater cover is located between an outer side of the washing tub and an inner side of the water-storing tub, and the heater cover is in contact with the water-storing tub and is spaced apart from the washing tub.

5. The washing machine according to claim 4, wherein a peripheral portion defining the washing water introduction slot is depressed downward from a surface of the heater cover.

6. The washing machine according to claim 4, wherein a peripheral portion defining the washing water discharge slot is depressed upward from a surface of the heater cover.

7. The washing machine according to claim 4, wherein a spacing between a portion of the outer side of the washing tub and a portion of the inner side of the water-storing tub is substantially equal to a spacing between the heater cover and another portion of the outer side of the washing tub opposite the heater cover.

8. A washing machine comprising:

a water-storing tub for storing washing water;

a heater comprising a heat-generating unit disposed above a bottom surface of the water-storing tub to generate heat and a terminal unit formed on opposite ends of the heat-generating unit;

a clamp fastening the heat-generating unit; and a thermostat inserted in and directly coupled to the bottom surface of the water-storing tub and having a first end bonded to the clamp to detect a temperature of the heater, wherein the clamp is bonded to an upper surface of the first end, the entire surface of the clamp being spaced apart from the bottom surface of the water-storing tub, the thermostat is coupled to the bottom surface of the water-storing tub after the entire clamp is inserted in the water-storing tub, and the thermostat supports the clamp in a state where the thermostat is coupled to the bottom surface of the water-storing tub.

9. The washing machine according to claim 8, wherein the heat-generating unit comprises:

a first bent portion distant from a first end of the heat generating unit at a predetermined length, a second bent portion distant from the first bent portion at a predetermined length, and a third bent portion distant from the second bent portion at a predetermined length, the first and second bent portions are symmetrically disposed with reference to the second bent portion.

10. The washing machine according to claim 9, wherein inner curvature surfaces of the first and third bent portions are inserted in the clamp.

11. The washing machine according to claim 8, wherein the clamp has a first end bonded to the thermostat and at least one curved portion.

12. The washing machine according to claim 8, wherein the clamp comprises a first curved portion bent at a portion distant from a point bonded to the claim by a predetermined length in a horizontal direction and a second curved portion defined by a plurality of bending portions, the first and second curved portions being symmetrically formed.

13. The washing machine according to claim 12, wherein the heat-generating unit comprises a straight section interconnecting the first and second bent portions, the straight section being fitted in the first curved portion.

14. The washing machine according to claim 12, where the heat-generating unit comprises a straight section interconnecting the second and third bent portions, the straight section being fitted in the second curved portion.

* * * * *